US006085919A

United States Patent [19]

Singer

[11] Patent Number: 6,085,919

[45] Date of Patent: Jul. 11, 2000

[54] BOTTLE CAP WITH PRIZE

[76] Inventor: Uri Singer, 305 E. 86th St., Apt. 14MA, New York, N.Y. 10028

[21] Appl. No.: 09/191,706

[22] Filed: Nov. 13, 1998

Related U.S. Application Data

[63] Continuation-in-part of application No. 09/103,774, Jun. 24, 1998, abandoned.

[51] Int. Cl.[7] ..... B65D 23/12

[52] U.S. Cl. ..... 215/10; 215/227; 215/386; 220/521; 220/23.86; 220/212; 206/217; 446/77

[58] Field of Search ..... 215/6, 10, 227, 215/228, 386; 220/23.83, 23.86, 212, 503, 505, 521, 522; 206/216, 217; 446/71, 77, 250, 251; D21/463, 464

[56] References Cited

U.S. PATENT DOCUMENTS

| | | | |
|---|---|---|---|
| 1,784,684 | 12/1930 | Bell | 446/251 |
| 2,318,434 | 5/1943 | Strauch | 215/386 X |
| 2,975,547 | 3/1961 | Greve | 446/77 |
| 3,713,247 | 1/1973 | Parrilla | 446/71 |
| 4,583,651 | 4/1986 | Ostberg | 446/71 X |
| 5,037,087 | 8/1991 | Roth | 215/228 X |
| 5,114,374 | 5/1992 | Estiva | 446/77 |
| 5,372,827 | 12/1994 | Brauner et al. | 220/23.86 X |
| 5,743,423 | 4/1998 | Franco | 220/23.86 |

FOREIGN PATENT DOCUMENTS 2704209 4/1993 France .

*Primary Examiner*—Stephen K. Cronin
*Assistant Examiner*—Nathan Newhouse
*Attorney, Agent, or Firm*—Weiss & Weiss; Philip M. Weiss

[57] ABSTRACT

A set of bottle caps (attachments) which can contain a prize therein. The bottle caps being insertable over a bottle cap of a bottle. The bottle cap has a top and bottom container having a central opening therein. Together the top and bottom container form a hollow container which is capable of holding a prize. The central opening of the container must be of sufficient size to accept the bottle cap therein.

10 Claims, 4 Drawing Sheets

Fig. 3
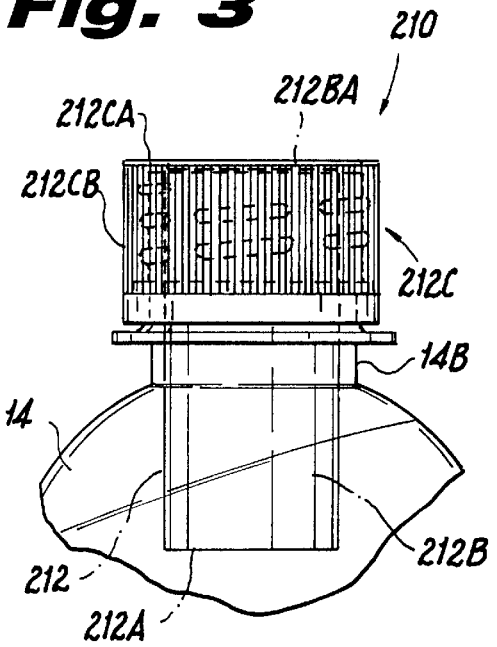
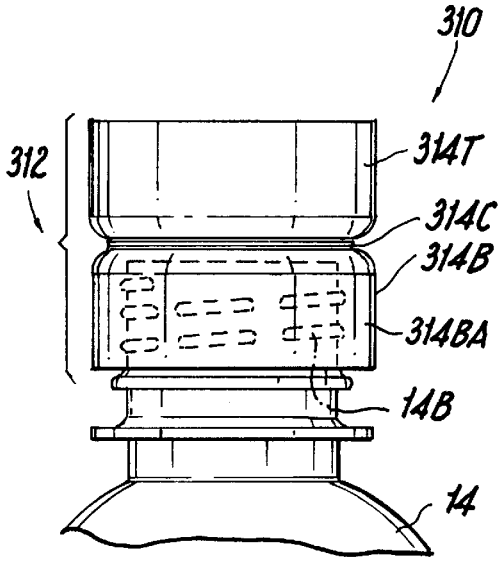
Fig. 4
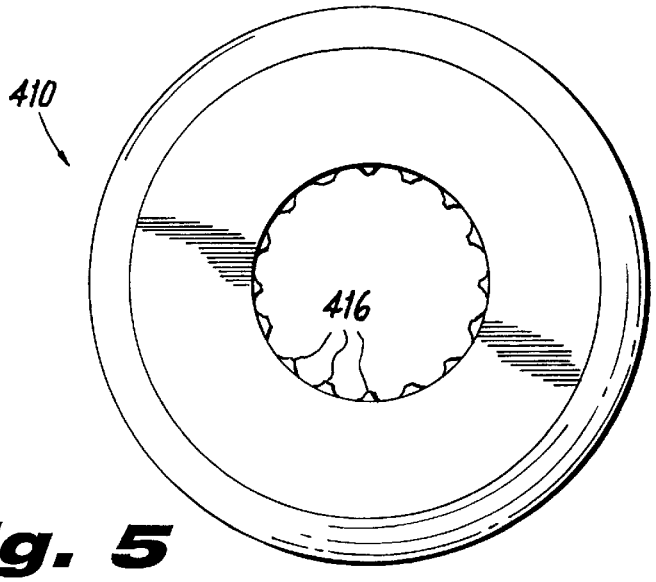
Fig. 5
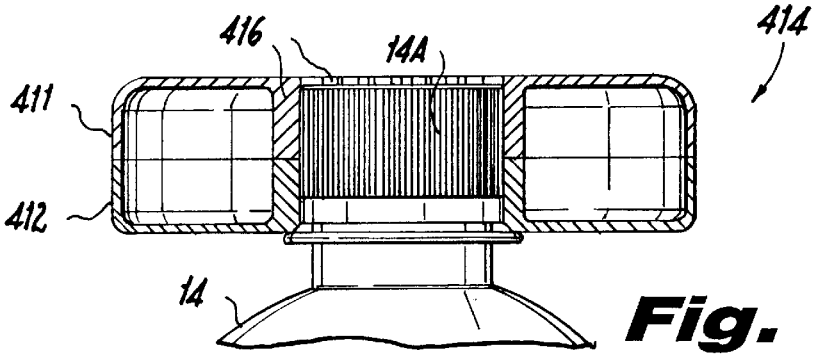
Fig. 6

BOTTLE CAP WITH PRIZE

This application is a continuation in part of application Ser. No. 09/103,774 filed on Jun. 24, 1998, now abandoned.

BACKGROUND OF THE INVENTION

1. Field of the Invention

The present invention relates to bottle caps. More particularly, the present invention relates to bottle caps having game paraphernalia incorporated therein.

2. Description of the Prior Art

Product marketing often uses enticements to gain a market share. One such enticement is a prize of chance device which is located on the cap of beverages such as soda, juices, and other fluid food products. The physical space and volume have heretofore been limited to the space on the underside of the bottle cap or the outside of the container. While off product devices, such as coupons and toys, are offered, these add undesirable material handling and coordination tasks all along the distribution chain. Prior art devices provide tamper indication, and spills but do not offer improvement over the peel off devices currently in use. What is needed, is a device, which is either a part of a bottle cap or can be attached to a bottle cap late in the manufacturing process, that has additional volume for containment of objects as well as printed material.

In U.S. Pat. No. D365,020, titled Combined Cosmetic Container and Cap, invented by Pierre Dinand, an ornamental design for a combined cosmetic container and cap, is shown and described.

The patented invention differs from the present invention because the patented invention is an ornamental design for a combined cosmetic container and cap. The patented invention lacks features similar to the present invention.

In U.S. Pat. No. 5,361,919, titled Combination Bottle Cap and Construction Toy, invented by Harold L. Hull and Jorge Montalva, a combination bottle cap and stackable toy is described which allows the bottle caps to be accumulated and then affixed together form various shapes and configurations, thus providing an incentive for the user to purchase a bottle having the stackable cap.

The patented invention differs from the present invention because the patented invention is a combination bottle cap and a stackable toy which allows the bottle caps to be accumulated and then affixed together. The patented invention lacks features similar to the present invention.

In U.S. Pat. No. 4,583,651, titled Novelty Bottle Cap-toy Top, invented by Werner Ostberg, a novelty bottle cap-toy top is described which, may be used to seal a bottle and/or a toy top. The bottle cap-toy top comprises a hollow shell of generally semi-spherical configuration and a stem. The hollow shell has a top flat outer surface and opposite thereto a lower opening through which there is an inwardly extending sealing portion adapted to engage and seal the throat of a bottle. The stem, generally perpendicular to both the top flat outer surface and the plane of the lower opening, extends from the interior of the cap, through the opening, and outwardly therefrom. When the cap, top flat portion down, is spun by the stem on a horizontal surface, the cap will rotate out of its central axis through ever larger circles until the end of the stem contacts the horizontal surface causing the cap to jump into an inverted position and spin on the tip of the stem. As the spinning slows, the top falls, rolls on its surface and comes to rest on the top flat face.

The patented invention differs from the present invention because the patented invention is a novelty bottle cap-toy top. When the cap is spun by the stem on a horizontal surface, the cap will rotate out of its central axis through ever larger circles until the end of the stem contacts the horizontal surface causing the cap to jump into an inverted position and spin on the tip of the stem. As the spinning slows, the top falls, rolls on its surface and comes to rest on the top flat face. The patented invention lacks features similar to the present invention.

In U.S. Pat. No. 4,050,600, titled Container Spillage Prevention System, invented by Martin C. Jennings, a container spillage prevention system for preventing the leakage or spilling of liquid contained within a bottle through a nipple opening when the bottle is positionally located on a substantially horizontal surface is described. The spillage prevention system may also be used as a toy device which provides for a teething ring for a child. Additionally, the system has a contamination resistant feature such that the nipple of the bottle is positionally displaced from the surface upon which the bottle is resting to negate the possibility of continued contact of the nipple with a contaminated surface. The container spillage prevention system includes a cap member which engages the neck portion of a bottle where the cap has an opening through which the nipple may be mounted. A ring element is secured to a lateral wall of the cap member having dimensions such that an acute angle is formed between a peripheral surface of the bottle and the substantially horizontal surface upon which it is in contact.

The patented invention differs from the present invention because the patented invention is a cap member which surrounds the neck portion of a bottle. The cap has an opening through which the nipple may be mounted. A ring element is secured to a lateral wall of the cap member having dimensions such that an acute angle is formed between a peripheral surface of the bottle and the substantially horizontal surface upon which it is in contact. The diameter of the ring is preselected to prevent the bottle from tipping beyond an angle at which fluids flow out the nipple. The present invention is a container having a cylindrical top and a bottom. The top and bottom are threadably attached at an outer perimeter. The top and bottom form a cavity which can hold a prize. A central opening formed in the container is adapted to cooperate with an outside diameter of a bottle cap. The central opening has a latching device therein. The bottle cap has a latching device, which engages the latching device in the central opening. The latching devices function to prevent the container from being removed from the bottle cap when the bottle cap is installed on a bottle. The prize can be for example, toys, literature, clues, awards, coupons, rebates, or pieces of puzzles, or any other item which can fit inside the cavity of the container. The prize is placed in the container and the container placed on top of the bottle cap. When the latches engage, the container cannot be removed from the bottle cap, until the bottle cap is removed from the bottle.

Numerous innovations for bottle caps have been provided in the prior art that are adapted to be used. Even though these innovations may be suitable for the specific individual purposes to which they address, they would not be suitable for the purposes of the present invention as heretofore described.

SUMMARY OF THE INVENTION

The present invention is a bottle cap having a cylindrical top and a bottom. The top and bottom are threadably attached at an outer perimeter. The top and bottom form a cavity which holds a prize. A central opening formed in the container is adapted to cooperate with an outside diameter of a bottle cap. The central opening has a latching device therein. A bottle cap has a latching device which engages the latching device in the central opening. The latching devices function to prevent the container from being removed from the bottle cap when the bottle cap is installed on a bottle. A prize can be for example, toys, literature, clues, awards, coupons, rebates, or pieces of puzzles or any other item which can fit inside the cavity of the container. The prize is placed in the container and the container placed on top of the bottle cap. When the latches engage, the container cannot be removed from the bottle cap. The container can have different shapes and sizes. In one embodiment the container can be in the shape of an animal or character. The only element required by the container is that it must be capable of being secured to the bottle cap or bottle. In a further embodiment the container can be compartmentalized, so that separate items can be placed in the container and not mixed together. The container for example, can then be used as a pill or vitamin dispenser or holder.

The types of problems encountered in the prior art are spill prevention and tamper proofing of bottles. In the prior art, unsuccessful attempts to solve this problem were attempted namely: peel of shields and rings preventing a bottle from tipping over. However, the problem is solved by the present invention because a container is provided which attaches to a bottle cap or is a part of a bottle cap. The container has sufficient room to contain a prize or chance device.

The present invention solved a long felt need for a device to contain small objects attached to a bottle cap.

Accordingly, it is an object of the present invention to provide a first bottle cap which has a first prize container.

More particularly, it is an object of the present invention to provide a first prize container bottom defined by a first prize container outer skirt with an attachment means at an outer rim functioning to attach to a first container top.

In keeping with these objects, and with others which will become apparent hereinafter, one feature of the present invention resides, briefly stated, in a first prize container bottom which defines a compartment for holding prize devices.

When the bottle cap is designed in accordance with the present invention, a first prize container inner skirt, has a first prize container inner skirt opening that encompasses a bottle cap.

In accordance with another feature of the present invention a first prize container top lip is removably and securely attached to an outer rim functioning.

Another feature of the present invention is that a second bottle cap has a container which projects into a bottle neck opening.

Yet another feature of the present invention is that a second prize container skirt is securely attached to a bottle cap on one end.

Still another feature of the present invention is that a second prize container bottom is securely attached to a bottom end of the second prize container skirt.

Yet sill another feature of the present invention is that a third bottle cap is a Yo-Yo.

A further object of the present invention is to provide a fourth bottle cap (attachment). The fourth bottle cap (attachment) has a hollow cavity and a hole in the center to allow placement on the bottle or bottle cap. The hollow cavity can be used to place a prize inside. The fourth bottle cap (attachment) can allow the bottle cap of the bottle to protrude through the center of the hollow container.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

LIST OF REFERENCE NUMERALS UTILIZED IN THE DRAWINGS

Common Components
14—bottle (14)
14A—bottle cap (14A)
14B—bottle neck (14B)
First Embodiment
110—first bottle cap (110)
112—first prize container (112)
112A—first prize container bottom (112A)
112B—first prize container outer skirt (112B)
112C—first prize container inner skirt (112C)
112CA—first prize container inner skirt opening (112CA)
112D—first prize container top (112D)
112DA—first prize container top lip (112DA)
Second Embodiment
210—second bottle cap (210)
212—second prize container (212)
212A—second prize container bottom (212A)
212B—second prize container skirt (212B)
212BA—second prize container skirt top (212BA)
212C—second prize container cap (212C)
212CA—second prize container cap top (212CA)
212CB—second prize container cap threaded skirt (212CB)
Third Embodiment
310—third bottle cap (310)
312—Yo-Yo (312)
314T—Yo-Yo top (314T)
314B—Yo-Yo bottom (314B)
314BA—Yo-Yo bottom threaded skirt (314BA)
314C—Yo-Yo string (314C)

BRIEF DESCRIPTION OF THE DRAWINGS

FIG. 3 is a side view of a second bottle cap.

FIG. 4 is a side view of a third bottle cap.

FIG. 5 is a top view of a fourth bottle cap (attachment).

FIG. 6 is a side view of a fourth bottle cap (attachment).

DESCRIPTION OF THE PREFERRED EMBODIMENT

Figure 1:
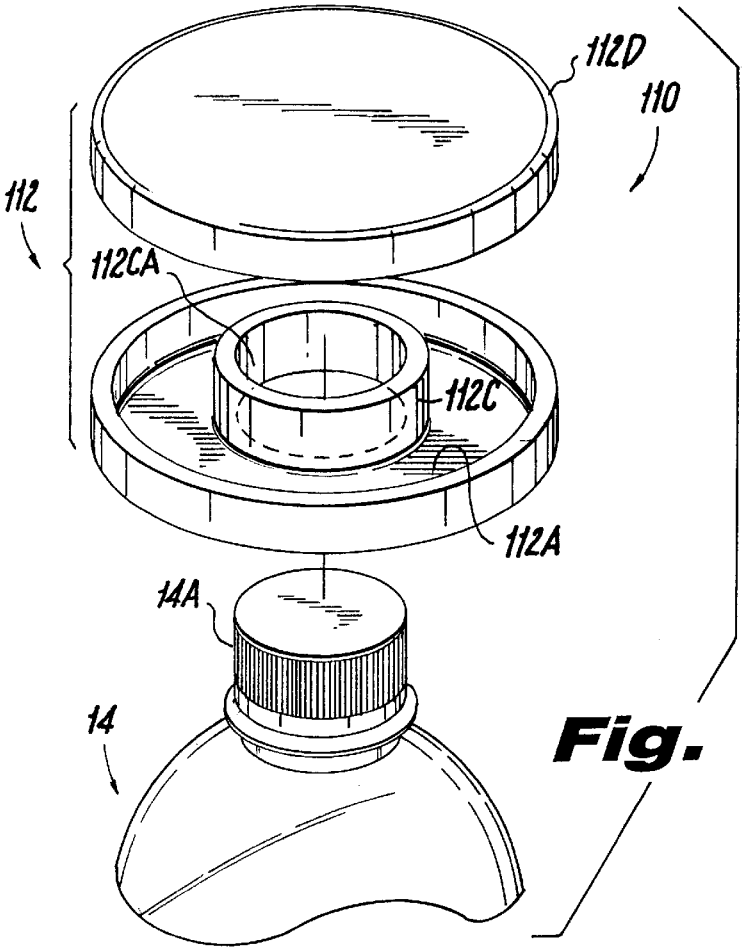
FIG. 1 is an exploded perspective view of a first bottle cap.
Figure 2:
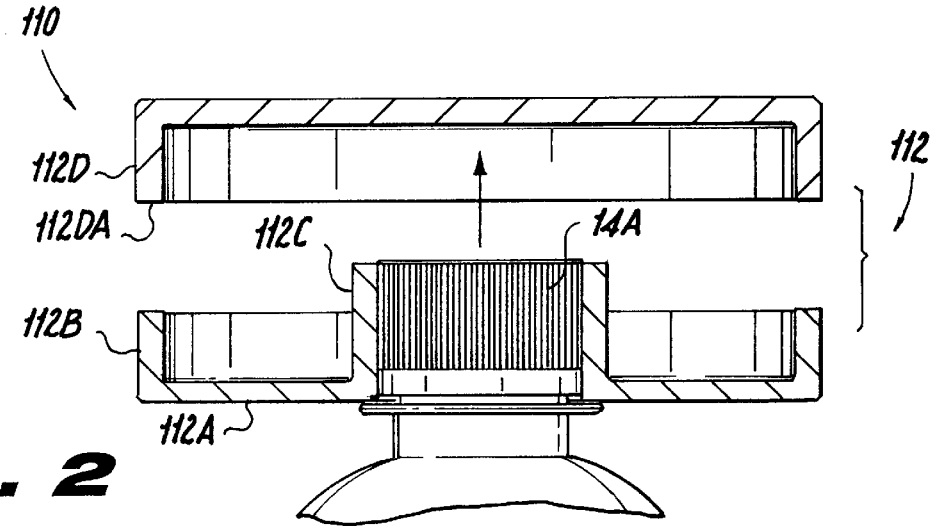
FIG. 2 is an exploded cross sectional side view of a first bottle cap.

Firstly, referring to FIG. 1 which is an exploded perspective view of a first bottle cap (110) and to FIG. 2 which is an exploded cross sectional side view of a first bottle cap (110).

A first bottle cap (110) contains a prize therein. The first bottle cap (110) is insertable over a bottle cap (14A) of a bottle (14). The first bottle cap (110) comprises a first prize container (112) which comprises a first prize container bottom (112A) having a central opening therein. The first prize container bottom (112A) comprises a first prize container outer skirt (112B) which is positioned around a periphery extending upwardly therefrom and a first prize container inner skirt (112C) positioned around the central opening extending upwardly therefrom. The first prize container (112) comprises a hollow first prize container top (112D) removably positionable on the first prize container outer skirt (112B) forming a cavity therebetween containing a prize therein. The first prize container inner skirt (112C) comprises a first prize container inner skirt opening (112CA) having sufficient size to accept the bottle cap (14A) therein.

The first prize container top (112D) further comprises a first prize container top lip (112DA) positioned around a periphery functioning to form a tight seamless engagement with the first prize container outer skirt (112B).

The first bottle cap (110) can be manufactured from plastic, plastic composite, metal and metal alloy or any material used to make bottle caps.

The first prize container inner skirt (112C) comprises a height in a range from about ⅛ to about 3 inches, but can vary based on the size of the bottle cap 14A.

The first prize container outer skirt (112B) height will vary depending on the size of the prize that will be placed in the container (112).

The first prize container top (112D) height will vary depending on the size of the bottle cap 14A and the size of the prize.

Next, referring to FIG. 3 which is a side view of a second bottle cap (210) container having a prize therein. The second bottle cap (210) is insertable over and within a bottle (14). The second bottle cap (210) comprises a second prize container (212) which comprises a second prize container bottom (212A) having a second prize container skirt (212B) positioned around a periphery extending upwardly therefrom. The second prize container skirt (212B) comprises a smaller diameter than a bottle neck (14B). Further, a second prize container skirt top (212BA) is removably attachable to a second prize container cap top (212CA) of a second prize container cap (212C) forming a prize container therebetween. The second prize container cap (212C) comprises a second prize container cap threaded skirt (212CB) which is engagable to an outer threaded surface of the bottle neck (14B).

The second bottle cap (210) can be manufactured from plastic, plastic composite, metal and metal alloy, or any material used to make bottle caps.

The second prize container skirt (212B) and the second prize container bottom (212A) can be made transparent or translucent.

Referring to FIG. 4 which is a side view of a third bottle cap (310), the third bottle cap (310) comprises a Yo-Yo (312). The Yo-Yo (312) comprises a round Yo-Yo top (314T) connected to a round Yo-Yo bottom (314B) having a Yo-Yo sting (314C) therebetween. The Yo-Yo bottom (314B) comprises a Yo-Yo bottom threaded skirt (314BA) engagable with a threaded bottle neck (14B). The third bottle cap (310) can be manufactured from plastic, plastic composite, metal, metal alloy, wood, wood composite, or any material used to make used to make bottle caps.

FIGS. 5–8 illustrate a fourth bottle cap (attachment) (410). Fourth bottle cap (attachment) (410) is made of a top container (411) and a bottom container (412). Although the figures illustrate two pieces (411) and (412) which make up the container (414), any of a number of pieces can be used to make up a container (414). Together top container (411) and bottom container(412) make up a hollow container (414). Within hollow container (414) can be placed any of a number of items, such as toys, literature, clues, awards, coupons, rebates, pieces of puzzles, or any other item which can fit inside the cavity of the container (414). The shape of container (414) can vary. In one embodiment, as illustrated by FIG. 5, the container (414) is in the shape of a circle. However, other shapes can be used, such as the shape of animals, characters, or practically any other shape. The only requirement, is that the container (414) have a means for attaching securely to the bottle (14) or bottle cap (14A). FIG. 5 illustrates the use of teeth (416) to securely attach to a bottle cap (14A). FIG. 6 illustrates the container (414) being securely attached to bottle cap (14A). Other means known in the art can be used to attach the container (414) to the bottle cap (14A), such as an adhesive, the container (414) can be friction fit onto the bottle cap (14A), or the container (414) can be snapped or locked onto the bottle cap (14A). In a preferred embodiment, when attaching the container (414) to bottle cap (14A) such means must be able to secure the container (414) to the bottle cap (14A) so that the container (414) can not be removed from the bottle cap (14A) while the bottle cap (14A) is secured on the bottle (14). In a further embodiment, the means for attachment of the container (414) to the bottle (14) or bottle cap (14A) do not require the bottle cap (14A) to be removed from bottle 14 before the container (414) can be removed. However, in this embodiment the container (414) must still be capable of being securely attached to the bottle (14) or bottle cap (14A).

Figure 7:
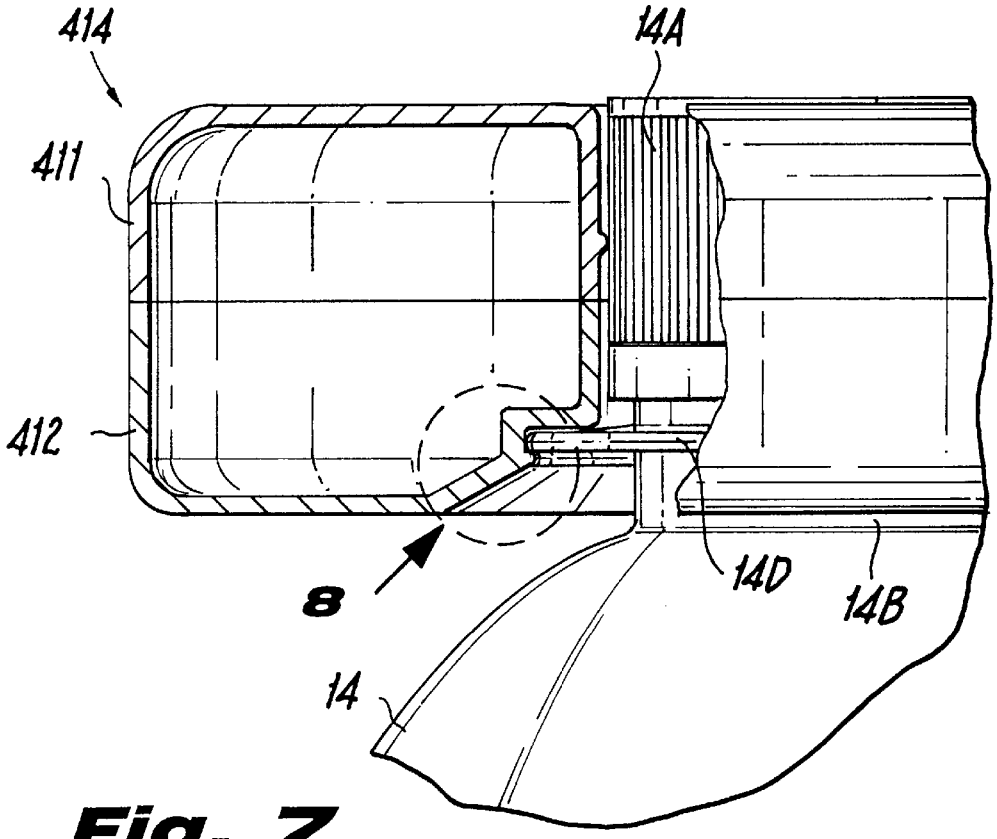
FIG. 7 is a side view of a fourth bottle cap (attachment).
Figure 8:
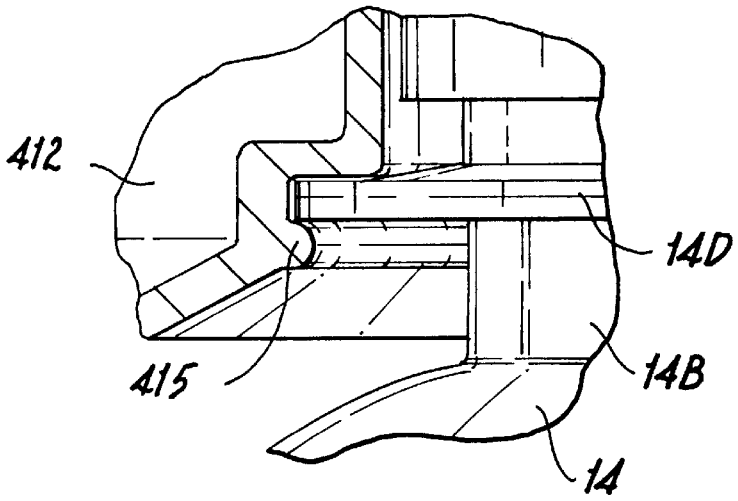
FIG. 8 is an exploded view of a fourth bottle cap (attachment).

FIGS. 7 and 8 illustrate a preferred embodiment of the present invention. FIGS. 7 and 8 show the container (414) securely attached to bottle cap (14A) by teeth (416). The height of container (414) should allow bottle cap (14A) to either be even with the top of the container (414) or to protrude through container (414). This allows for the bottles to be stacked more easily. FIGS. 7 and 8 further show an additional way of securing the container (414) to the bottle (14). A locking mechanism (415) is placed under the lip (14D) of the bottle (14).

Figure 9:
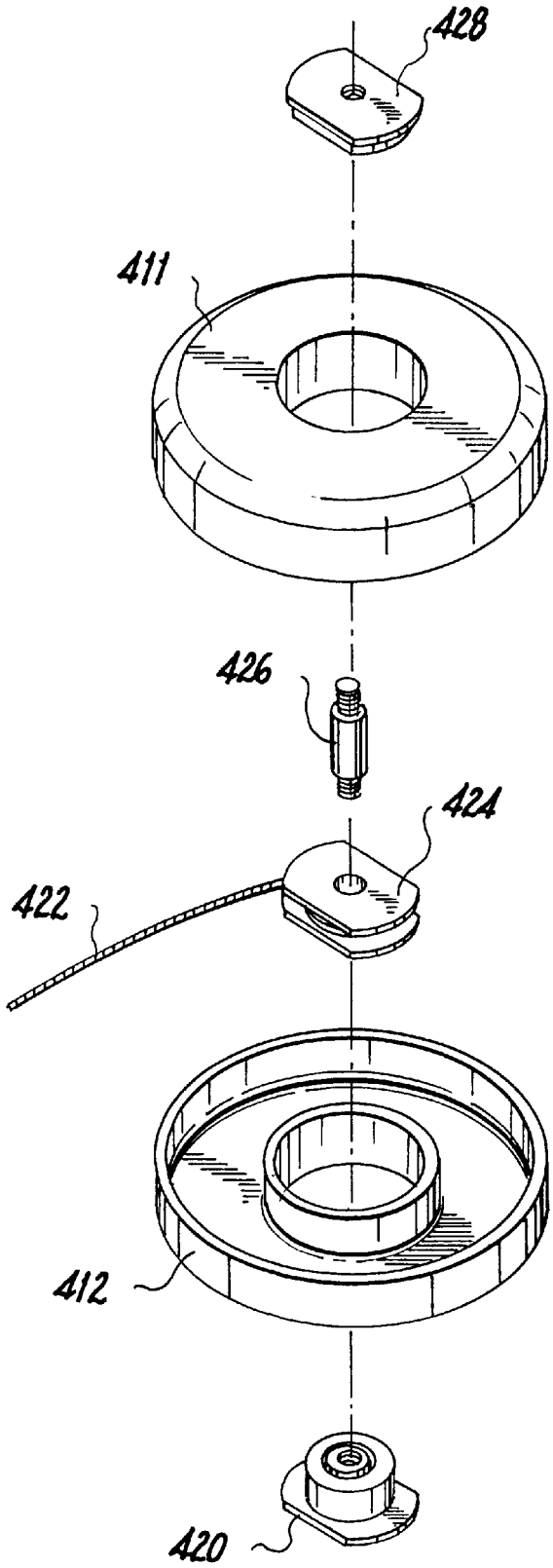
FIG. 9 is an illustration of the fourth bottle cap (attachment) used as a yo-yo.

FIG. 9 illustrates the use fourth bottle cap (attachment) (410) as a yo-yo. Top container (411) and bottom container (412) make up the two halves of the yo-yo. An axis fixer (420) is placed through the center of bottom container (412) while a second axis fixer (428) is placed through the center of top container (411). A string holder (424) having string (422) is placed between top container (411) and bottom container (412). An axis (424) is placed through the center of string holder (424), and axis fixers (420) and (428). The axis (424) is preferably made of steel or another type of metal. In a preferred embodiment, all of the pieces, (420), (422), (424), (426) and (428) fit inside container (414).

The first bottle cap (110), and fourth bottle cap (attachment) (410) can have the prize unit heat sealed within the container and then the container may be press fit on to bottle cap (14A).

Although each of the embodiments illustrated above show the bottle caps being attached to the top of the bottle, using the securing means described above, the bottle cap can be attached to other parts of the bottle.

It will be understood that each of the elements described above, or two or more together, may also find a useful application in other types of constructions differing from the type described above.

While the invention has been illustrated and described as embodied in a bottle cap, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims.

What is claimed is:

1. An attachment being capable of insertion over a bottle cap of a bottle, the attachment comprising;

a top piece having an inner wall, an outer wall and a central opening;

a bottom piece having an inner wall, an outer wall and a central opening;

said top and bottom pieces when placed together forming a hollow container;

a through opening formed by the central openings of the top and bottom pieces extending entirely through the hollow container such that said bottle cap can extend entirely through said container;

said hollow container being capable of being securely attached to said bottle; said attachment is attached to said bottle via teeth formed in said opening of said hollow container.

2. The attachment in claim 1 wherein said attachment is manufactured from a material comprising either plastic, plastic composite, metal, or metal alloy.

3. The attachment described in claim 1 wherein said hollow container contains a prize.

4. The attachment described in claim 1 wherein said attachment has a shape of an animal.

5. The attachment described in claim 1 wherein said attachment is attached to said bottle via a additional locking mechanism.

6. The attachment described in claim 1 wherein height of said attachment is less than or equal to height of said bottle cap.

7. The attachment described in claim 1 wherein said attachment can not be removed from said bottle until said bottle cap is removed.

8. The attachment of claim 1 wherein said attachment contains a string, string holder, and an axis, and said attachment can be used as a yo-yo.

9. A combination of an attachment, a bottle and a bottle cap, the combination comprising:

a bottle having a neck;

a bottle cap to close the neck of the bottle;

an attachment comprising a hollow container having an inner wall, an outer wall, and a through opening extending entirely through said container;

said bottle cap extending entirely through said container;

said container is securely attached to said bottle or said bottle cap such that said container can not be removed until said bottle cap is removed.

10. The combination of claim 9 wherein said container is made up of at least two pieces.

* * * * *